US005779835A

United States Patent [19]

Rello et al.

[11] Patent Number: 5,779,835

[45] Date of Patent: Jul. 14, 1998

[54] METHOD AND APPARATUS FOR APPLYING LABELS TO ARTICLES USING BOTTOM FEED CHAIN CONVEYOR

[75] Inventors: Robert Michael Rello, Slatington; Michael Yager, Shaver; Ramon Antonio Martinez, Wilkes-Barre, all of Pa.

[73] Assignee: CMS Gilbreth Packaging Systems, Inc.

[21] Appl. No.: 551,986

[22] Filed: Nov. 2, 1995

Related U.S. Application Data

[63] Continuation-in-part of Ser. No. 427,289, Apr. 21, 1995, which is a continuation-in-part of Ser. No. 342,780, Nov. 21, 1994, abandoned.

[51] Int. Cl.[6] ..... B65C 9/00

[52] U.S. Cl. ..... 156/187; 156/215; 156/446; 156/448; 156/556

[58] Field of Search ..... 156/215, 86, 446, 156/448, 449, 450, 566, 567, 568, DIG. 31, DIG. 38, 556

[56] References Cited

U.S. PATENT DOCUMENTS

| | | | |
|---|---|---|---|
| 2,613,007 | 10/1952 | Von Hofe . | |
| 2,668,632 | 2/1954 | Zimpel | 156/455 |
| 2,703,660 | 3/1955 | Von Holfe et al. | 156/571 X |
| 3,159,521 | 12/1964 | Pechmann . | |
| 3,235,433 | 2/1966 | Cvacho et al. . | |
| 3,565,724 | 2/1971 | Yamaguchui et al. . | |
| 3,577,293 | 5/1971 | Ritterhoff . | |
| 3,604,584 | 9/1971 | Shank, Jr. . | |
| 3,659,394 | 5/1972 | Hartleib et al. . | |
| 3,765,991 | 10/1973 | Hoffmann . | |
| 3,834,963 | 9/1974 | Hoffman . | |
| 3,878,960 | 4/1975 | Jonsson et al. . | |
| 3,957,570 | 5/1976 | Helm | 156/568 X |
| 4,108,709 | 8/1978 | Hoffman . | |
| 4,108,710 | 8/1978 | Hoffmann . | |
| 4,108,711 | 8/1978 | Hoffmann . | |
| 4,124,433 | 11/1978 | Herdzina et al. . | |
| 4,207,832 | 6/1980 | Bowman et al. . | |
| 4,208,236 | 6/1980 | Santefort . | |

(List continued on next page.)

FOREIGN PATENT DOCUMENTS

| | | | |
|---|---|---|---|
| 1012906 | 6/1977 | Canada . | |
| 144198 3 | 6/1985 | European Pat. Off. . | |
| 0219267A2 | 4/1987 | European Pat. Off. . | |
| 0235872 | 9/1987 | European Pat. Off. . | |
| 0579985 | 1/1994 | European Pat. Off. . | |
| 1229536 | 7/1960 | France . | |
| 2427987 | 6/1978 | France . | |
| 1103230 | 3/1961 | Germany . | |
| 1924131 | 11/1970 | Germany | 156/449 |
| 0208261 | 1/1987 | Germany . | |
| 995524 | 6/1965 | United Kingdom . | |
| 1106653 | 3/1968 | United Kingdom . | |
| 1129022 | 10/1968 | United Kingdom . | |
| 2029280 | 3/1980 | United Kingdom . | |

*Primary Examiner*—James Engel
*Attorney, Agent, or Firm*—Morgan & Finnegan, LLP

[57] ABSTRACT

A method and apparatus is disclosed for applying a label onto a substantially cylindrical article by using a bottom feed conveyor unit formed of two chain loops each formed from a plurality of interconnected chain links. Substantially parallel support rods extend between the chain loops and are supported by the chain links. The support rods are spaced a distance sufficient to allow an article to rest thereon. The label drum defines an article wrapping position at a lower portion of the label drum. A thin layer, heat activated adhesive backed label is fed onto the surface of the drum so that the adhesive back faces outward from the drum. The label drum is rotated to move the label retained thereon into the article wrapping position. As the label is moved, the adhesive is heated so that the adhesive obtains a sufficient temperature to melt. A cylindrical article is conveyed substantially horizontally along a conveyor into the article wrapping position and into rotative engagement with the label retained on the label drum so as to transfer the label onto the cylindrical article by wrap-around labeling.

23 Claims, 8 Drawing Sheets

U.S. PATENT DOCUMENTS

| | | | |
|---|---|---|---|
| 4,216,044 | 8/1980 | Herdzina et al. . | |
| 4,242,167 | 12/1980 | Hoffmann . | |
| 4,323,416 | 4/1982 | Malthouse et al. . | |
| 4,332,635 | 6/1982 | Holbrook et al. . | |
| 4,336,095 | 6/1982 | Hoffmann . | |
| 4,347,094 | 8/1982 | Watanabe | 156/568 X |
| 4,347,095 | 8/1982 | Yamashita . | |
| 4,366,016 | 12/1982 | Golden, Jr. . | |
| 4,406,721 | 9/1983 | Hoffmann . | |
| 4,416,714 | 11/1983 | Hoffmann . | |
| 4,425,866 | 1/1984 | Hoffmann . | |
| 4,443,285 | 4/1984 | Roth et al. . | |
| 4,447,280 | 5/1984 | Malthouse . | |
| 4,475,974 | 10/1984 | Perini | 156/457 X |
| 4,496,409 | 1/1985 | Kontz . | |
| 4,500,386 | 2/1985 | Hoffman . | |
| 4,519,868 | 5/1985 | Hoffmann . | |
| 4,526,645 | 7/1985 | Malthouse et al. . | |
| 4,544,431 | 10/1985 | King . | |
| 4,545,832 | 10/1985 | Hoffmann . | |
| 4,552,608 | 11/1985 | Hoffmann et al. . | |
| 4,561,928 | 12/1985 | Malthouse . | |
| 4,574,020 | 3/1986 | Fosnaught . | |
| 4,604,154 | 8/1986 | Fosnaught . | |
| 4,629,528 | 12/1986 | Tanaka et al. . | |
| 4,632,721 | 12/1986 | Hoffmann et al. . | |
| 4,636,278 | 1/1987 | Wesley . | |
| 4,662,925 | 5/1987 | Thimons et al. . | |
| 4,671,836 | 6/1987 | Fumei . | |
| 4,686,931 | 8/1987 | DiFrank . | |
| 4,693,210 | 9/1987 | DiFrank . | |
| 4,694,633 | 9/1987 | Fujio et al. . | |
| 4,704,173 | 11/1987 | Hoffman . | |
| 4,724,037 | 2/1988 | Olsen . | |
| 4,726,872 | 2/1988 | Olsen . | |
| 4,729,811 | 3/1988 | DiFrank . | |
| 4,735,668 | 4/1988 | Hoffmann . | |
| 4,761,200 | 8/1988 | Szeremeta . | |
| 4,772,354 | 9/1988 | Olsen et al. . | |
| 4,781,785 | 11/1988 | Szeremeta . | |
| 4,832,774 | 5/1989 | DiFrank et al. . | |
| 4,844,760 | 7/1989 | Dickey . | |
| 4,844,957 | 7/1989 | Hoffman . | |
| 4,923,557 | 5/1990 | Dickey | 156/448 X |
| 4,931,122 | 6/1990 | Mitchell . | |
| 4,977,002 | 12/1990 | Hoffman . | |
| 4,984,413 | 1/1991 | Cosmo . | |
| 5,037,499 | 8/1991 | Bright et al. . | |
| 5,045,140 | 9/1991 | Dickey . | |
| 5,078,826 | 1/1992 | Rogall . | |
| 5,091,040 | 2/1992 | Otruba . | |
| 5,091,239 | 2/1992 | Przeworski et al. . | |
| 5,116,452 | 5/1992 | Eder . | |
| 5,344,519 | 9/1994 | Galchefski et al. . | |
| 5,350,482 | 9/1994 | Westbury . | |
| 5,399,216 | 3/1995 | Galchefski et al. . | |
| 5,401,353 | 3/1995 | Westbury et al. . | |
| 5,405,487 | 4/1995 | Galchefski et al. . | |
| 5,437,759 | 8/1995 | Westbury . | |
| 5,458,728 | 10/1995 | Galchefski et al. . | |
| 5,458,729 | 10/1995 | Galchefski et al. . | |

METHOD AND APPARATUS FOR APPLYING LABELS TO ARTICLES USING BOTTOM FEED CHAIN CONVEYOR

This application is a Continuation-In-Part of copending patent application Ser. No. 08/427,289 filed Apr. 21, 1995 which is a continuation-in-part application of U.S. patent application Ser. No. 08/342,780, filed Nov. 21, 1994 now abandoned, the disclosures which are hereby incorporated by reference in their entirety.

FIELD OF THE INVENTION

This invention relates to a method and apparatus for applying a label to a cylindrical article such as a crayon with a heat activated adhesive backed label by using a bottom feed conveying unit.

BACKGROUND OF THE INVENTION

Many millions of crayons and other similar articles are sold throughout the world by different vendors in competition with each other. Increases in the number of articles which are to be produced per minute, reduction in costs, and increased efficiency are necessary and desirable in this competitive global market.

Crayons are typically made from a soft material such as paraffin wax, which is impermeable to moisture but sometimes difficult to wrap with a label because the crayon's surface is slick, making adhesive adherence difficult. Also, crayons and other similar articles are sometimes tapered about 0.005 to 0.010 inches over their two to four inch length. This taper makes application of a label to the crayon even more difficult because the label ends often will not align together due to the taper.

In one prior art method, a precut label having an inexpensive flour based adhesive on one side thereof is placed over a slot. The crayon is laid on the label and pushed into the slot. The label is bent around the crayon and then the crayon is rolled at least about one revolution to wrap the label about the crayon. The crayon and moist adhesive are then allowed to dry. Typically, the machines used for labelling these crayons in accordance with this prior art method produce about 180 crayons a minute.

Because of increased competition and the concomitant necessity to increase production and reduce costs, it is desirable to increase labeling speeds of crayons and other similar articles to at least about 500 to 600 pieces per minute. Glue-solvent technology offers some possibilities for increasing labelling speeds. However, this technology is not as desirable because the solvents used in such large production runs are environmentally undesirable and may not work with wax-like crayons and other similar articles where a large adhesive label surface is required.

In the copending related application, an apparatus and method applies a label onto a substantially cylindrical article using a label drum to feed labels to an article wrapping position where cylindrical articles are labeled. A thin layer heat activated adhesive backed label is fed onto the surface of the label drum so that the adhesive back faces outward from the drum. The adhesive is heated as the drum rotates so that the adhesive obtains a sufficient temperature to melt.

Substantially cylindrical articles, such as crayons, are conveyed from a hopper and chute located at the top portion of the label transport drum into a serpentine track, and then into a star wheel transfer assembly which rotates and guides the crayons onto the surface of the label drum. The label film is fed through a dancer and feed roll assembly and then fed to the bottom portion of the label drum into a cutting roll assembly where the film is cut and transported as cut labels onto the drum. As the drum rotates, labels move upward into an article wrapping position located at the top portion of the label transport drum at the point where the articles are discharged from the serpentine track and star wheel transfer assembly.

To ensure that an operator has no trouble visually inspecting the articles fed from the hopper, through the serpentine track and into the star wheel transfer assembly, the articles are fed substantially horizontally along a predetermined path of travel into the article wrapping position at the lower portion of the label drum and into rotative engagement with a label retained on the label drum. The articles are delivered by a belt drive conveyor having article retainers formed from two spaced rollers that support the article. The rollers are supported on a plate typically threaded to a conveyor belt.

SUMMARY OF THE INVENTION

In accordance with the present invention, the advantages and features of the present invention now allow a method and apparatus which applies a label onto a substantially cylindrical article using a conveyor that supports the article on a substantially horizontal chain conveyor formed of two chain loops each formed from a plurality of interconnected chain links. Substantially parallel support rods extend between the chain loops and support the chain links. The support rods are spaced at a distance sufficient to allow an article to rest thereon. The labels are transferred onto the cylindrical article by wrap around labeling.

A thin layer heat activated adhesive backed label is fed onto the surface of a label drum so that the adhesive back faces outward from the drum. The drum is rotated to move the label retained thereon into an article wrapping position at the lower portion of the drum. The adhesive is heated as the drum rotates so that the adhesive obtains a sufficient temperature to melt. As the cylindrical articles are conveyed into the article wrapping position by the conveyor, the label is transferred onto the cylindrical article by wrap-around labeling. The article is conveyed along a substantially arcuate path around the lower portion of the label drum and into engagement with the outer drum surface. The film is fed onto the label drum at a position adjacent the upper portion of the drum. Articles are fed from a hopper and vacuum wheel. The articles are aligned at their ends by engaging the ends with a registration wheel. Each chain link includes a guide hole, and each rod includes a shaft extending into the guide hole and outwardly from the chain link. A bearing is received in an arcuate configured guide slot, so that the conveyor is moved around the lower portion of the drum. Pressure may be imparted to the articles as they are wrapped. Such pressure can be implied by imparting pressure on the article against a surface of the label drum and the label retained thereon.

DESCRIPTION OF THE DRAWINGS

These and other objects and advantages of the present invention will be appreciated more fully from the following description, with references to the accompanying drawings in which.

DETAILED DESCRIPTION OF THE INVENTION

Figure 1:
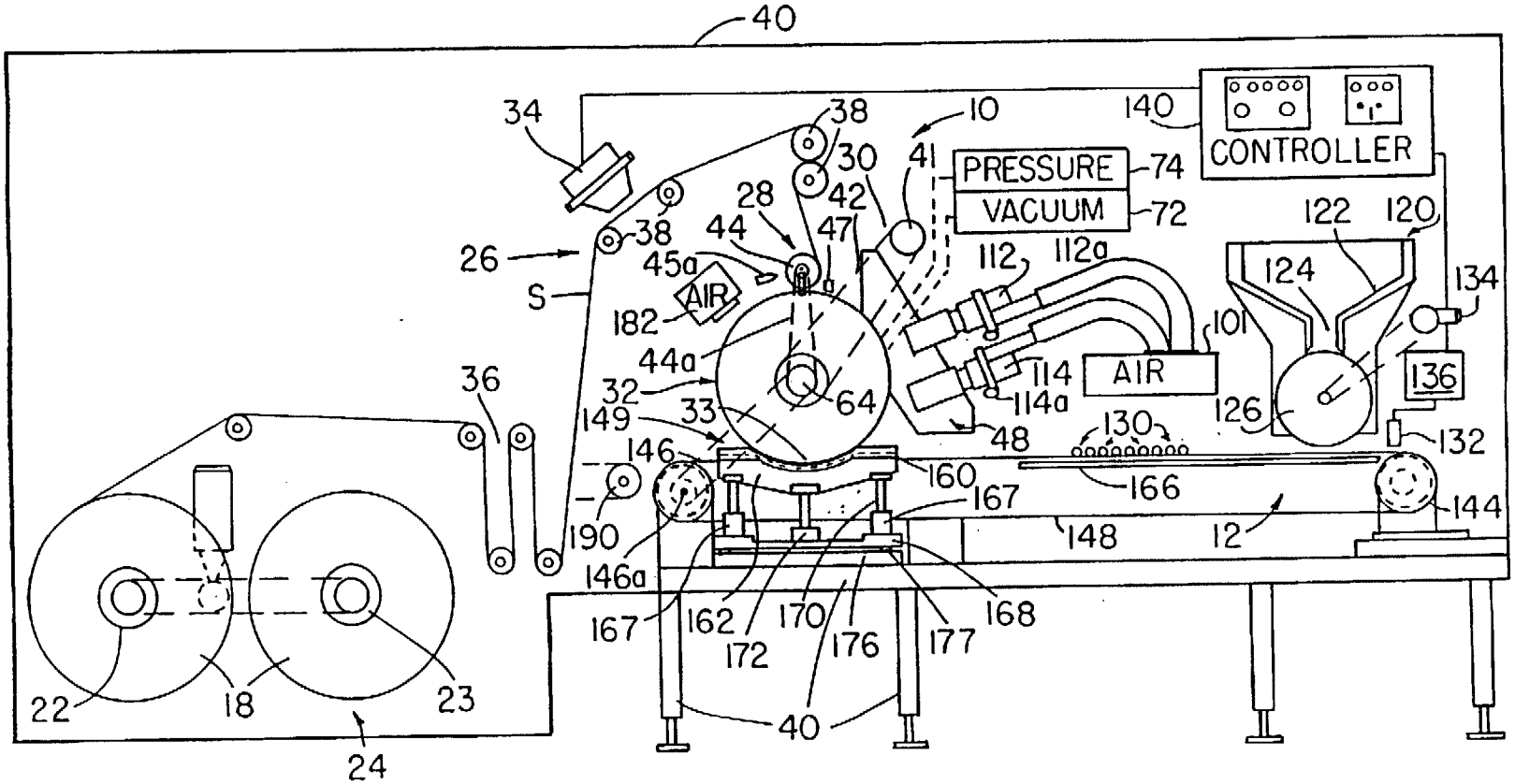
FIG. 1 is a schematic, elevation view of the overall apparatus which applies labels onto cylindrical articles such as crayons in accordance with the present invention using a bottom feed conveying unit.
Figure 12:
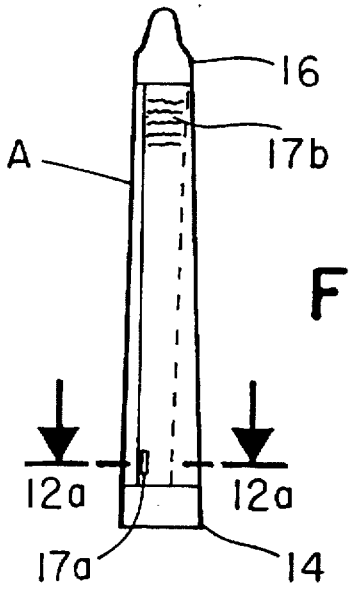
FIG. 12 is an isometric view of a novel crayon in accordance with the present invention which has been wrapped by the method of the present invention and showing with hidden lines the leading edge of the label engaging the butt end of the crayon during label wrapping, as well as a covered registration mark, and unexposed printed indicia.

Referring now to FIG. 1, there is illustrated at 10 a schematic, overall illustration of the apparatus for applying a label onto a substantially cylindrical article such as a tapered crayon wherein the label has seams aligned end-to-end on the article (FIG. 12) by using a bottom feed conveying unit, in the form of a chain conveyor, illustrated generally at 12. The bottom feed conveying unit 12 of the present invention allows an operator to visually inspect articles during advancement into an article wrapping position.

The labels are thin layer, heat activated adhesive backed labels typically having at least one layer of paper with the adhesive applied evenly on one side. Throughout this description, the labels will be referred to by the letter "L." The apparatus 10 may be used for applying labels to different tapered and nontapered articles and crayons requiring good end-to-end alignment of the label ends at high production speeds.

The apparatus 10 is suitable for high quality cylindrical labelling of different articles requiring the application of thin labels having a thickness typically less than about 0.005 inches. Throughout the description and drawings, the cylindrical articles on which the labels are applied will be referred to as crayons and will be illustrated as such and given the reference letter "A." The illustrated crayons are typically formed from paraffin wax, and have a surface which is smooth and slick, making it resistant to water and some adhesives. In one desired application, the crayons are tapered, having one end about 0.322 inches diameter and the other end about 0.314 inches diameter, giving a taper of about 0.007 inches from the wide "butt" end 14 of the crayon to the more narrow end 16. (FIG. 12) The crayons typically are about two to four inches long.

Figure 11:
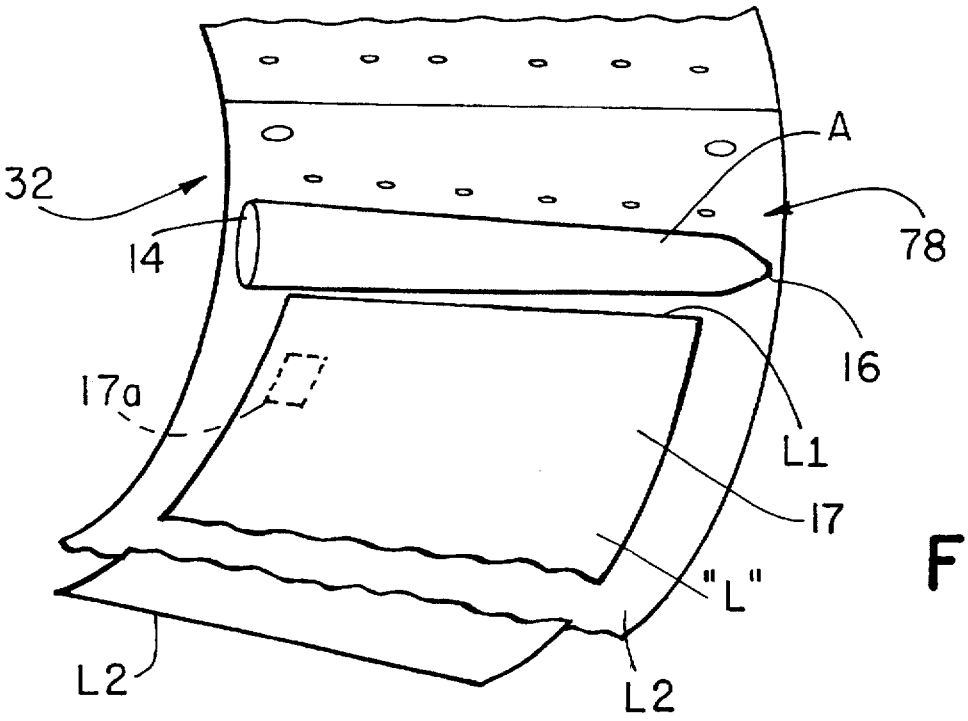
FIG. 11 is an exaggerated schematic, isometric view showing the leading edge of a label engaging the butt end of the crayon during label wrapping.
Figure 12A:
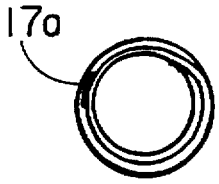
FIG. 12*a* is a schematic sectional view taken along line 12—12 of FIG. 12 showing the double wrapped crayon.

In one aspect of the invention, the label "L" applied to the illustrated crayons typically includes one layer of paper which is coated completely on one side with the heat activated adhesive 17 (FIG. 11). The paper can be a coarse grain paper which is inexpensive, but economical and practical considering the numerous crayons which are labelled. In accordance with the present invention, the heat activated adhesive layer is applied at about a one half to one mil coating thickness i.e., 0.0005–0.001 inches. The adhesive is a low temperature heat activated adhesive which melts at a temperature range of about 140° to 170° F. Typical examples include hot melt adhesives sold by Findley Adhesives, Inc., 300–634 and HB Fuller Company HM-0727. The label material typically includes printed indicia **17*b* which will be exposed after wrapping. A registration mark 17*a* can be included on the label material. This registration mark 17*a* is sensed by registration sensors during film feed to ensure proper cutting of the label at the desired point. Typically, a crayon or other article is double wrapped (FIG. 12*a*), and the registration mark 17*a* covered. The printed indicia 17*b***, such as advertising and date codes, is exposed.

In accordance with the present invention, the label materials are initially supplied as a roll 18 of strip label material "S" which can be positioned on a mandrel 22 of a feeder assembly indicated generally at 24. In the illustration, a double mandrel 22, 23 each holds a roll 18. As one roll 18 is used, the other roll 18 on mandrel 23 then is fed which maintains production. The strip "S" of label material is then fed through a feedroll assembly, indicated generally at 26, and to a cutting drum assembly, indicated generally at 28, which is operatively connected to the main drive motor and transmission assembly, indicated generally at 30, of a label drum indicated generally at 32. The cutting drum assembly 28 is located so that label material is fed and cut at the upper portion of the label drum 32. As the label drum 32 rotates, the label moves into an article wrapping position 33 located at the bottom portion of the label drum 32 where the articles are fed from the conveying unit 12.

A registration and sensing unit 34 senses the label registration mark to ensure proper cutting of the strip on the desired cut line and ensure quality cutting of the labels. The cutpoint on the strip label is based on the registration point. The registration and sensing unit 34 can include a FIFE label edge registration control and an optical system for reading printed label registration markers. The feedroll assembly 26 includes a dancer roll assembly 36 and feedrolls 38 which move the strip S into the cutting drum assembly 28.

The label drum 32 typically is supported on a frame assembly 40. The main drive motor and transmission assembly 30 is supported by the frame 40. The motor 41 rotates the label transport drum 32 by a suitable transmission 42. In the illustrated embodiment, the drive motor and transmission 30 rotates the label drum in a clockwise position.

Figure 2:
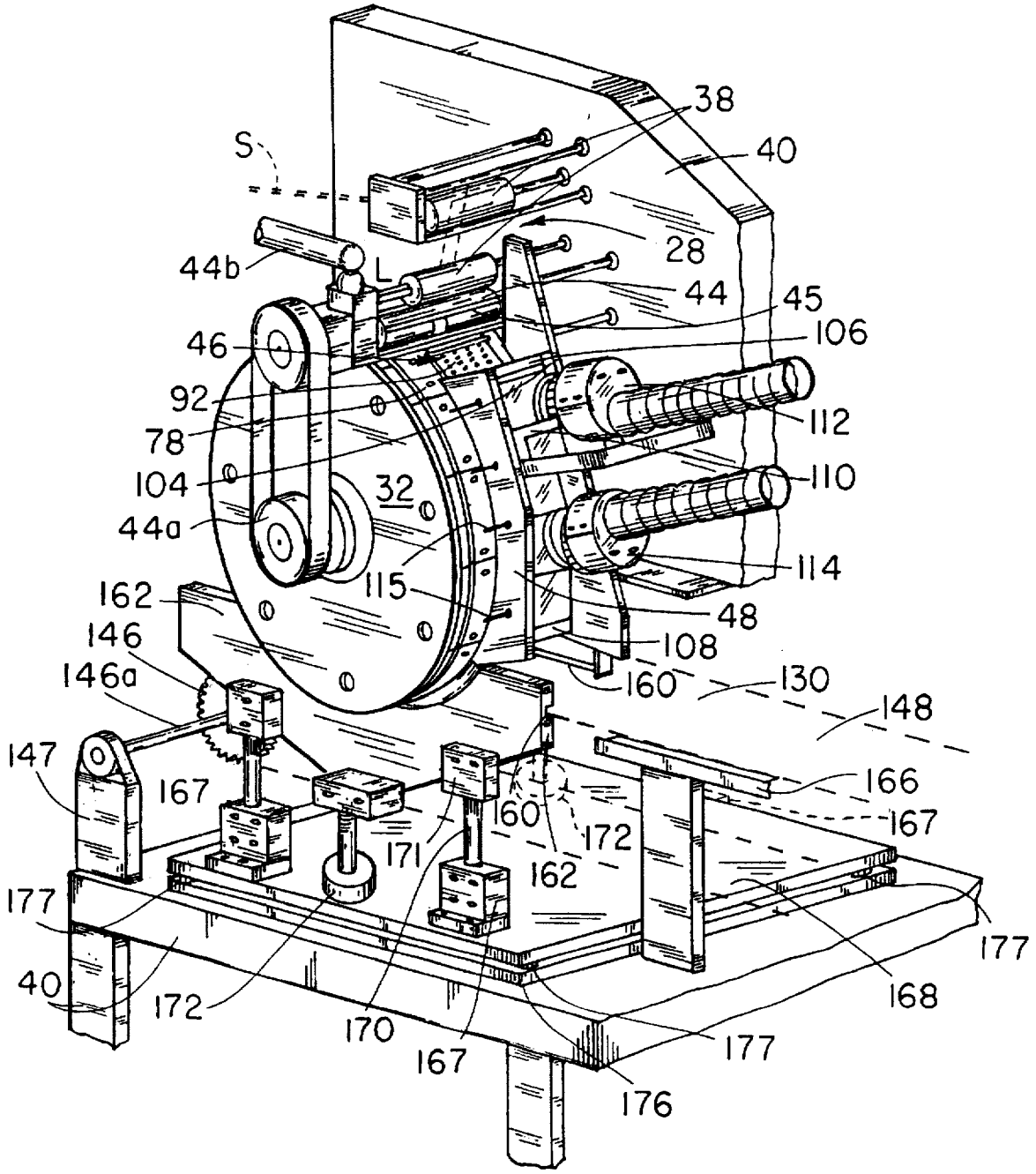
FIG. 2 is a schematic, isometric view of the label drum showing the label feed and cut mechanism, the heater assembly and bottom feed conveying unit.
Figure 3:
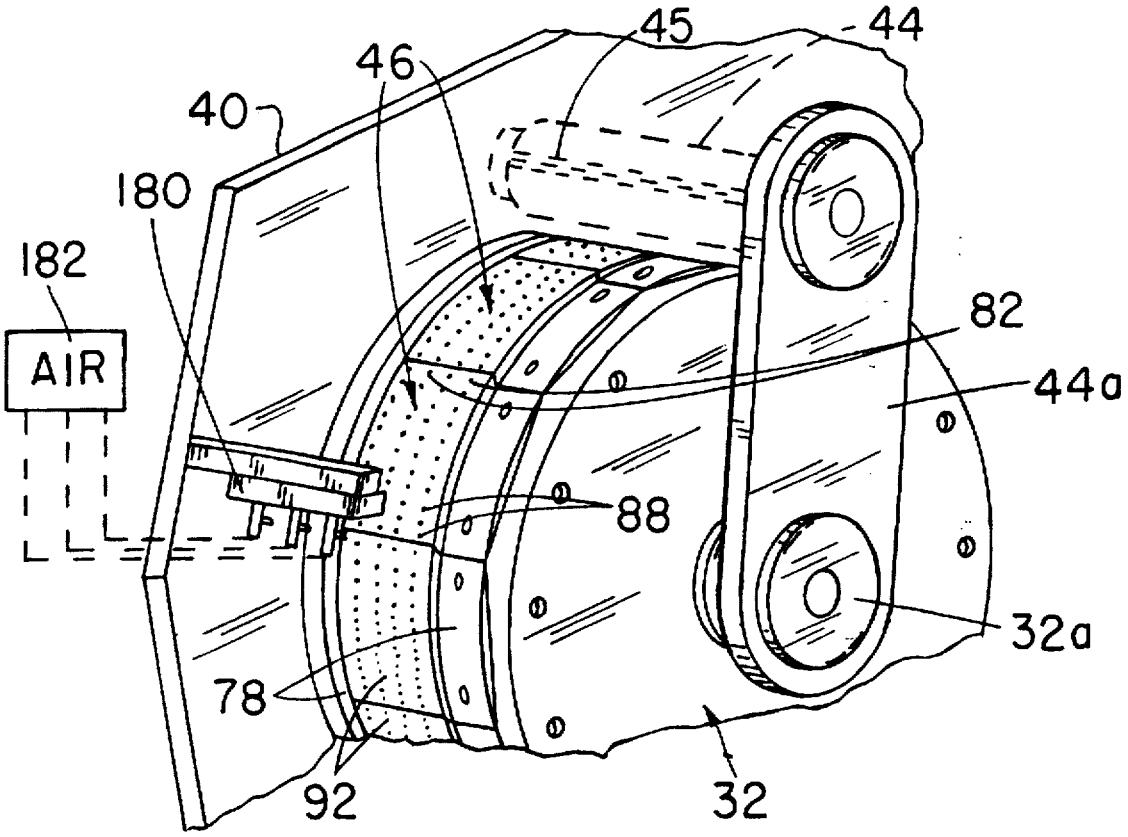
FIG. 3 is a schematic, isometric view of a portion of the label drum showing the jet air nozzles and a portion of the cutter assembly.

The cutting drum assembly 28 includes a cutting roll 44 which is mounted to the machine frame 40 and positioned adjacent the label transport drum 32 at an upper portion thereof as shown in FIG. 1. The cutting roll 44 has a carbide knife 45 positioned thereon (FIG. 2) which cuts the label strip into rectangular segments, i.e., labels "L", having leading and trailing edges, L1, L2. The leading edge L1 is transferred onto a label receiving position, indicated at 46, of the label transport drum 32. (FIGS. 2 and 3). The rest of the label then transfers to the label drum. The roll 44 is rotated by a transmission 44*a* driven from the label drum 32. The vacuum roll 44 can include vacuum draw which originates from a vacuum hose 44*b* connected to an internal manifold and orifices of the vacuum roll.

In one aspect of the present invention, the cutting roll 44 can include a carbon steel substrate formed at the periphery of the roll and can be received over a central mandrel. In accordance with the present invention, the surface of the cutting roll 44 is enhanced. A nickel alloy coating is deposited onto the substrate and has micropores. A polytetrafluoroethylene (Teflon) polymer is integrated within the nickel alloy coating to form an integrated surface layer of about 0.001 to 0.002 inches. The integrated surface layer has a surface hardness of about 65 to 68 Rockwell C scale. This surface has a coefficient of friction of about 0.03 (with 8 or lower RMS) so as to reduce the tendency of the label to build static and to aid in label transfer from the cutting drum onto the label drum. The cutting roll 44 with this surface has an operating heat resistance range of about −150° to +950° F.

The integrated surface can be formed by a coating process known commercially by the trade designation Magnaplate HMF and provided by General Magnaplate Corporation, 1331 Route 1, Linden, N.J. 07036.

Typically, when applying this surface enhancement, the substrate is pretreated and the nickel alloy is deposited on the substrate surface. Micropores are enlarged and the Teflon infused into the surface layer. The Teflon then is integrated within the layer.

Besides the improvements of hardness and reduced coefficient of friction, the cutting roll has improved durability and anti-static electrical properties. The impregnated surface layer imparts dielectric resistance, a low dissipation factor, and very high surface resistivity. It is believed that the surface resistivity is about 60 micro ohm/cm over a wide range of frequencies. The impregnated surface layer also has corrosion resistance. Salt spray per ASTM B-117 exceeds 336 hours when the thickness is 0.001 inches or greater. The Equilibrium Wear Rate (EWR) using Taber Abrasion testing methods (CS-10 wheel): 0.2–0.4 mg per 1000 cycles.

The cutting roll 44 is positioned adjacent the drum and a stationary knife 45*a* (FIG. 1) engages the cutting knife 45 to cut labels. Also, on-drum cutting can be used where the knife 45 engages a hardened surface of the label drum. An example of such cutting system is disclosed in U.S. Pat. No. 5,350,482 to Westbury, the disclosure which is hereby incorporated by reference. The choice of cutting method depends on the labels used, the speed of operation, operator demands, as well as other factors related to the type of labeling operation.

In accordance with the present invention, a static eliminator 47 (FIG. 1) is positioned just after the cutting drum assembly 28. The static eliminator 47 is beneficial because it reduces the heavy charge build-up. This can be critical because in very low humidity conditions the charge contained on the label causes the labels to stick to the surface of the cutting roll 44. The static eliminator 47 eliminates this charge which allows the label to transfer efficiently to the label drum 32.

Each label moves with the rotating label drum 32 into a heating tunnel, indicated at 48, where the adhesive is melted, and then into the article wrapping position 33, located at the bottom portion of the label drum 32, where crayons or other articles are fed by the conveying unit 12 into tangential spinning engagement with the drum surface and into rotative engagement with a leading edge L1 of the label "L" as the label moves into the article wrapping position 33. The label wraps about the crayon twice and adheres thereto by means of the melted adhesive. The wrapped crayons are then discharged into a discharge chute or discharge conveyor assembly illustrated generally at 52 (FIG. 1).

Figure 7:
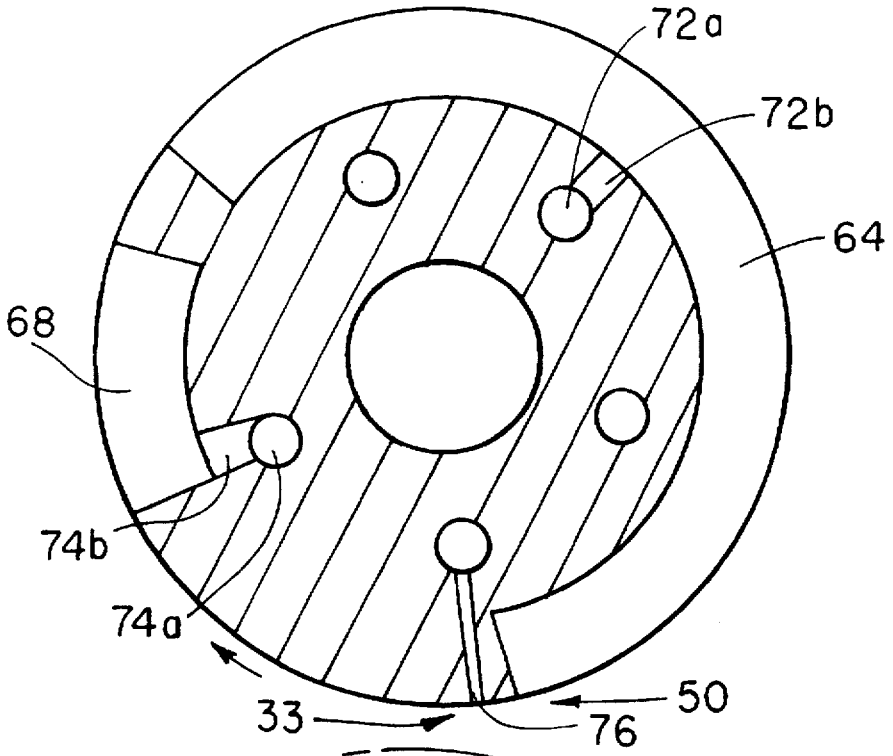
FIG. 7 is sectional view of the hub showing the first vacuum pressure and manifolds and blow-off manifold.
Figure 8:
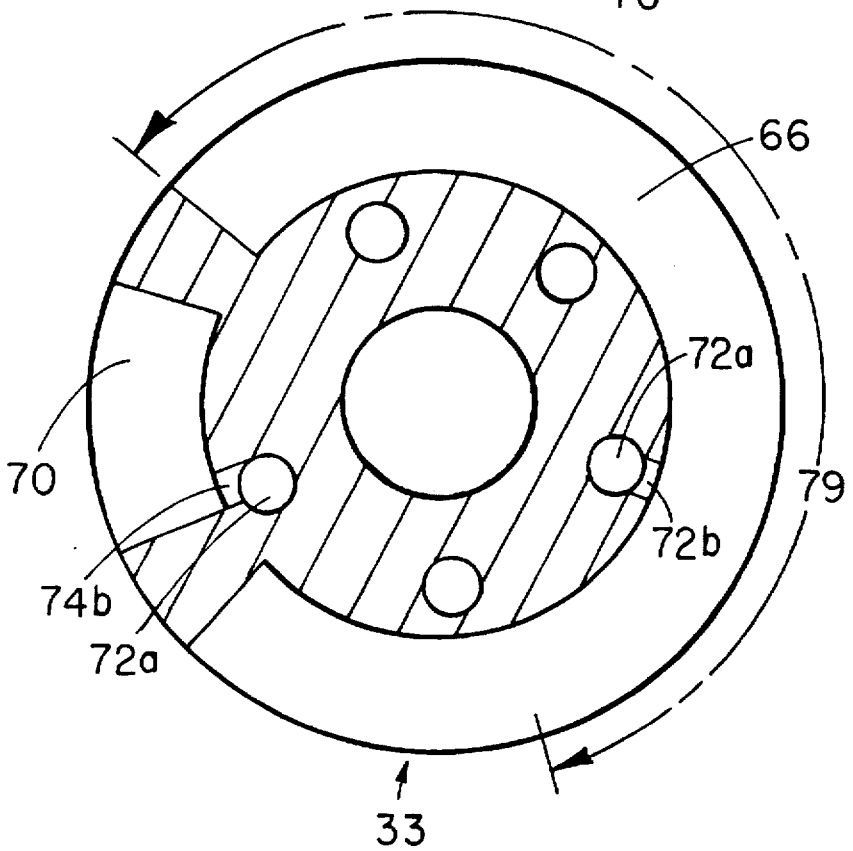
FIG. 8 is a sectional view of the hub showing the second vacuum manifold and blow-off manifold.

Referring now to FIGS. 4–8, details of one embodiment of the label drum 32 which can be used for the present invention is shown. As illustrated, an outer drum, indicated at 60, is rotatably received over a central hub 62. As shown in FIGS. 7 and 8, respective first and second radially extending, slotted vacuum manifolds 64, 66 and blow-off manifolds 68, 70 are formed on the outer surface of the hub 62. The vacuum and blow-off manifolds 64, 68 of FIG. 7 are aligned circumferentially with each other, as are the manifolds 66, 70 of FIG. 8 with each other.

Respective sources of vacuum and pressure (shown schematically at 72, 74 (FIG. 1) operatively connect to horizontal vacuum manifolds 72*a*, and gate manifolds 72*b*, and horizontal pressure manifolds 74*a*, and gate manifolds 74*b*. An air pressure manifold 76 provides air against a leading edge of a label. As will be explained later, the second vacuum manifold 66 extends a farther arc distance 79 than the first vacuum manifold 64. The second vacuum manifold 66 retains the label on the drum surface if a label is not transferred onto an article. Once the drum 60 continues its rotation, the blow-off manifolds 68, 70 exert pressure on the label to blow it from the drum surface. Further details of a hub and drum label construction which can be used in the present invention are set forth in U.S. Pat. No. 5,344,519, issued Sep. 6, 1994, the disclosure which is hereby incorporated by reference.

Figure 4:
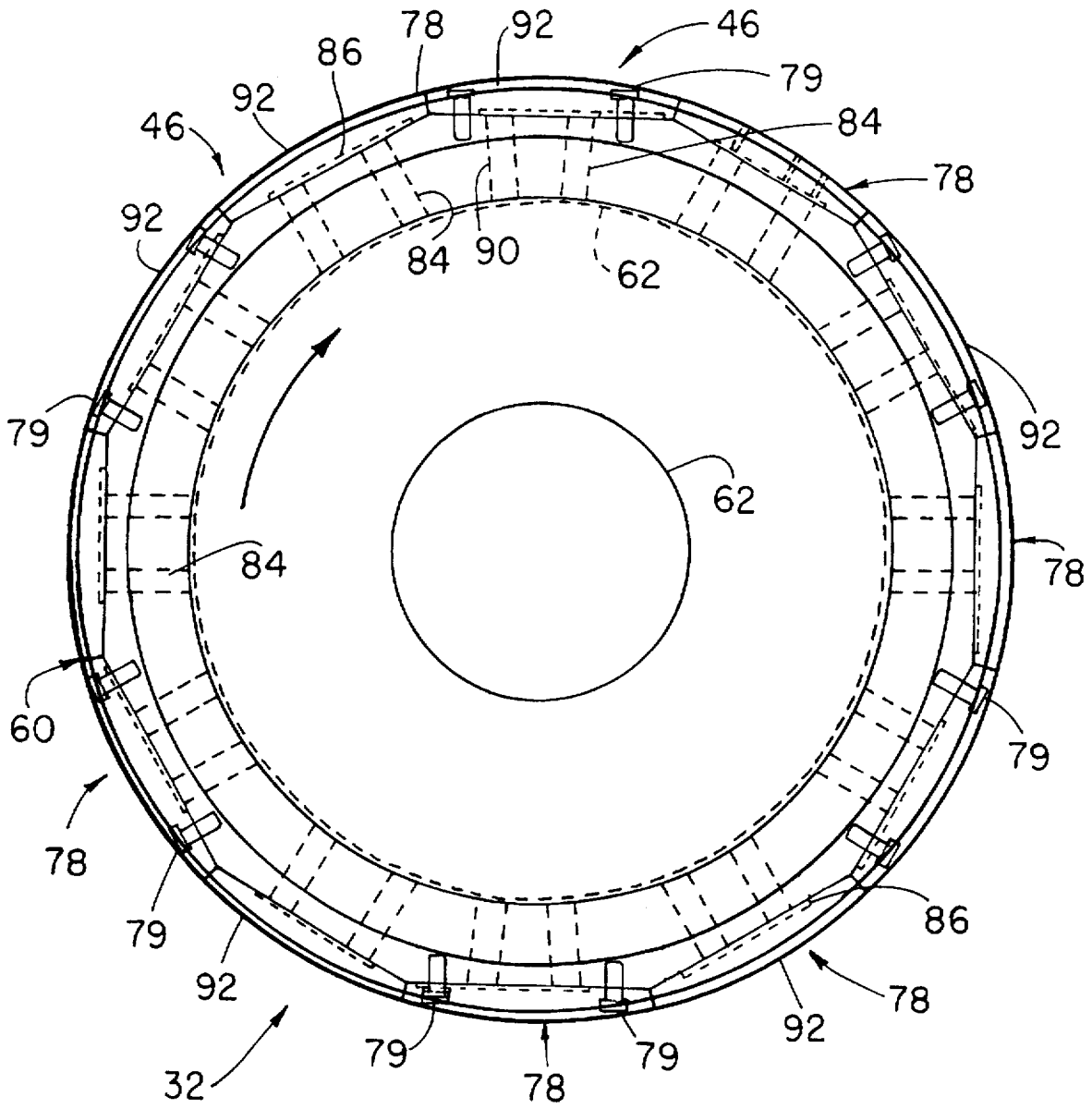
FIG. 4 is a partial sectional view of the label drum showing twelve evenly spaced label retaining insert plates positioned on the outer surface of the drum.
Figure 6:
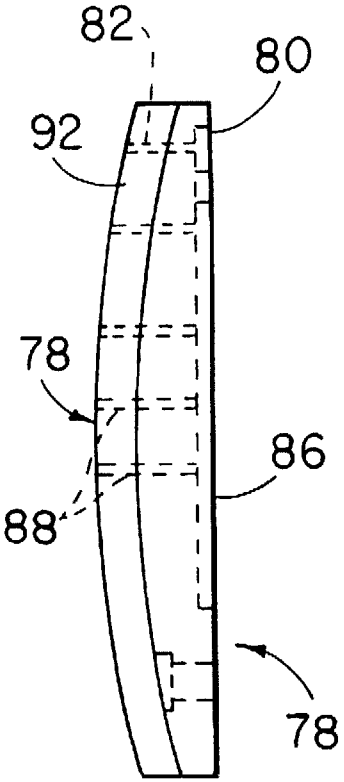
FIG. 6 is a side elevation view of a label retaining insert plate.
Figure 5:
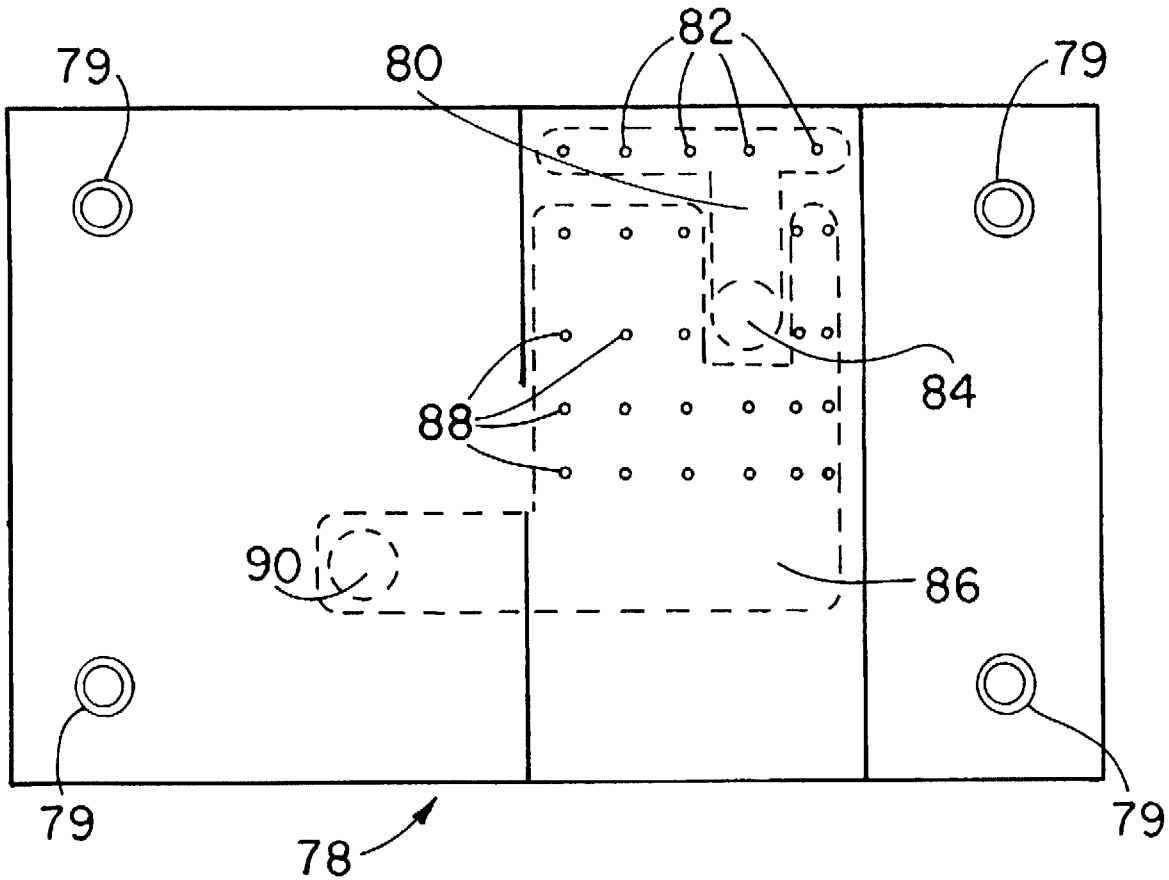
FIG. 5 is a top view of a label retaining insert plate.

Twelve evenly spaced label retaining insert plates, indicated at 78, are positioned on the surface of the label drum 60 (FIG. 4). Each insert plate 78 is rectangularly configured (FIG. 5), and has a top surface that is configured substantially similar to the curvature of the drum surface. Screws 79 can secure the plates 78 to the drum 60 and be used on every plate 78 or every other plate, with every other unscrewed plate held by contiguous screwed plates. The under surface of each insert plate includes two plenums formed in the surface as shown in FIG. 5. A first plenum 80 is formed on the undersurface and has orifices 82 extending upward which communicate with a surface of the insert plate at that area where the leading edge of a label is to be positioned. The first plenum communicates with a port 84 in the drum 60 which is positioned in circumferential alignment with the first vacuum manifold 64 and pressure manifold 76.

A second plenum 86 is formed in the undersurface and has orifices 88 extending upward therethrough to communicate with the surface of the insert plate at an area where the trailing edge and midportion of the label are positioned. The second plenum 86 extends to a port 90 of the drum which is aligned circumferentially with the second vacuum manifold.

Each insert plate 78 has a resilient pad 92 (FIGS. 2, 3, 4, and 6) placed over a substantial portion of the outer surface of the insert plate. The orifices 82, 88 are formed within the resilient pad 92. The resilient pads 92 can be formed preferably from silicon or other similar material. The pads 92 are contiguous with each other (FIGS. 3 and 4) and form a soft cushion on which the crayon rolls during wrapping and also forms a smooth surface on which the label lies as the label moves from its initial position after cutting when it is first fed onto the drum surface and then moves into the article wrapping position 33 (FIG. 2).

Because the silicon pads 92 act somewhat as a cushion, the crayon is deflected slightly into the cushion material by means of upward pressure exerted by the conveying unit against the crayon and label drum 32, so as to create a "footprint" in the soft cushion material. During crayon wrapping, the air is squeezed out between the crayon, label and pad surface, allowing better wrapping of the label about the crayon. Additionally, the silicon pads 92 have greater friction between the crayons in the drum surfaces compared to a steel or an aluminum surface so that less pressure need be applied by the upward biasing pressure of the conveyor.

The label retaining insert plates 78 are limited in the illustrated embodiment to about a four and one-half inch long label corresponding to about four and a half inch wide insert plate. This has been found adequate for labelling most conventional crayons and other similar articles, and also allow for wrapping the label twice about the article.

If longer labels are to be used for larger diameter articles, the insert plates 78 can be made deeper and fewer in number, and thus longer along the arcuate portion of the top surface since the plate is longer and has a longer surface length on which the arc extends. However, the length is still limited because too deep an insert plate 78 would interfere with the drum rotation about the hub. A larger label drum 60 and hub 62 would have to be constructed. Further details of one example of the plate construction which could be used for the present invention can be found in the incorporated by reference '519 patent.

Once the label is received into the label receiving position 46 on the label transport drum 32, vacuum holds the label onto the drum surface. The label transport drum rotates and moves the label into the heating tunnel 48 where the adhesive is heated to its melting point. At high operating speeds of about 500 to 600 articles per minutes, the heat time is about 0.25 seconds.

As shown in FIG. 2, the heating tunnel 48 is defined by two opposing side bracket plates 102, 104, a front and rear end plate 106, 108 and a top cover plate 110, and forms a heat tunnel positioned closely adjacent the surface of the label transport drum in a position before the article wrapping position as shown in FIG. 2. Two high powered ceramic heater and blower assemblies 112, 114 are mounted on the top plate 110 at the front and rear portions and are connected to a source of air flow 101. Both heaters produce a 1,000° F. blast of hot air. The first rear heater 112 amplifies and heats the heat activated adhesive, and the second front heater 114 amplifies that heat to ensure that the hot melt adhesive melts adequately. The total time in which the label is contained within the heat tunnel is about 0.25 seconds, and corresponds to the high operating speeds of about 500 to 600 crayons per minute. Temperature sensors 115, preferably thermocouples, sense temperature in the heating tunnel 48. The heater and blower assemblies 112, 114 then are adjusted accordingly. The system can be temperature controlled through a closed loop controller. Also, the heaters 112, 114 can be pivotally mounted on shafts 112*a*, 114*a* or on a slide plate (not shown) so that respective heaters can be pivoted or moved out of proximity to the label drum (FIG. 1).

As shown in FIG. 1, the crayons, are retained in a hopper, indicated at 120, spaced from the label drum. The hopper 120 includes a basin 122 with an inclined floor in which the crayons are contained. The lower portion of the basin has a through channel 124 which feeds into a large vacuum wheel 126 positioned at the lower discharge end of the basin and grabs a crayon at the 12:00 position, holds the crayon with its formed slots by vacuum and rotates it approximately 180 degrees to release it to rest between support rods 130 of the conveyor. The vacuum wheel 126 includes a source of vacuum (not shown) for retaining the crayons within the slots formed in the wheel.

A sensor (not shown) could be used to indicate when a rod 130 is approaching the drop off point of the vacuum wheel 126 and signal to a controller 140 the sensed location of the carrier. Vacuum wheel rotation is then timed so that the crayon is dropped onto the support rods 130 when the two support rods are opposite the drop off point defined by the lower-most point of the vacuum wheel 126. Vacuum wheel rotation can be controlled by a drive mechanism 134 which operatively connects to the sensor 132 via circuitry 136 and the controller. Once the crayon or other article has dropped onto the conveyor, each crayon resting on two support rods 130 is aligned by engaging a registration wheel 139.

As shown in FIG. 1, the chain conveyor 12 includes a distal drive sprocket 144 mounted to the frame 40 and a first proximal drive sprocket 146 adjacent the article wrapping position. An endless conveyor chain 148 is coupled about the two drive sprockets. (FIG. 2). The proximal drive sprocket 146 is mounted on a support shaft 146*a* rotatably mounted between shaft supports 147 fixed to the frame 40. In a preferred embodiment, the distal drive sprocket 146 includes a gear linkage (indicated generally at 149) which is geared to the label drum drive with a clutch mechanism for overload protection. In another embodiment, a drive motor could drive the distal drive sprocket 144 to move the conveyor 148. The controller 140 could operatively connect to the motor to allow an operator to control the conveyor.

Figure 9:
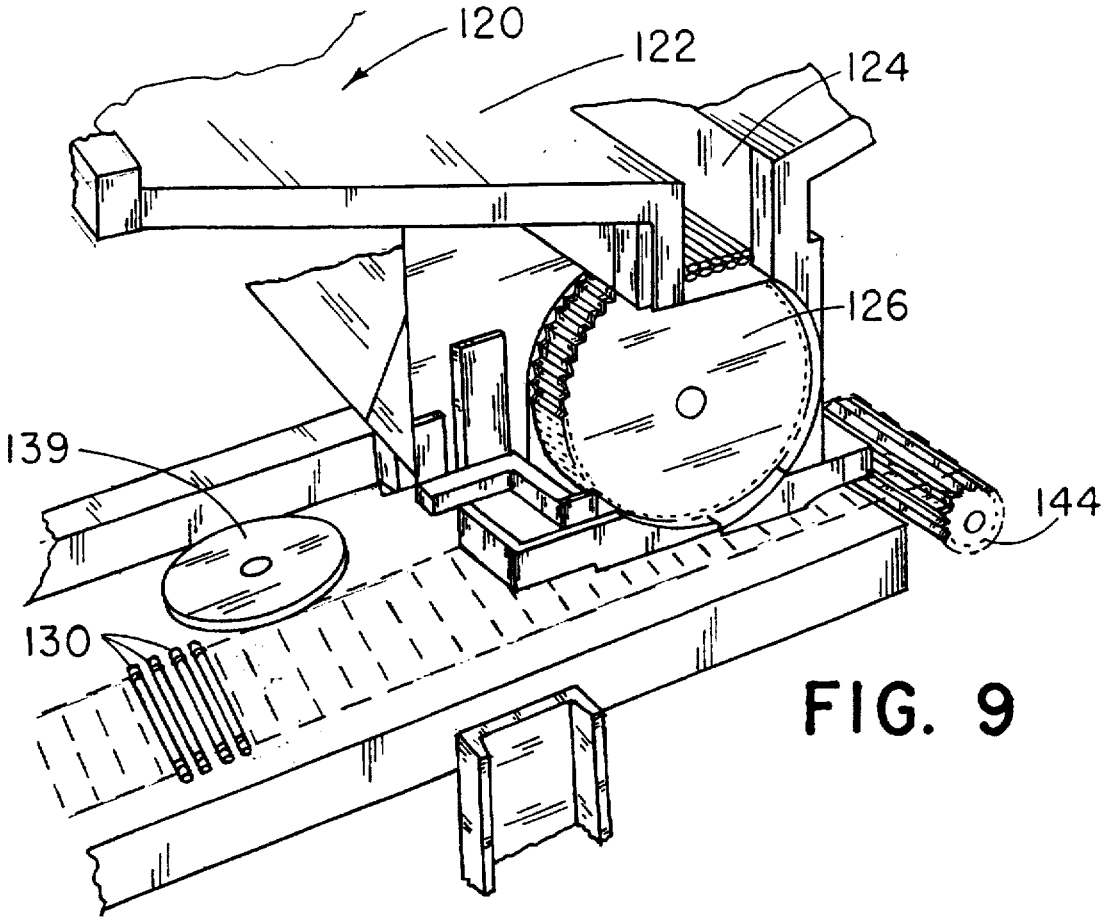
FIG. 9 is an isometric view of the vacuum wheel that feeds articles onto the conveyor.
Figure 10:
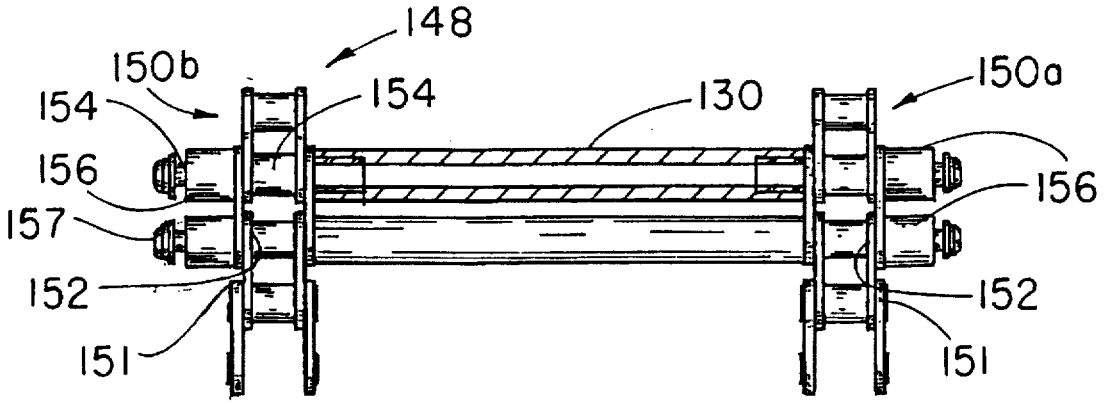
FIG. 10 is a plan view in partial section showing the chain links and chain of the chain conveyor.

As illustrated in FIG. 10, the chain conveyor 12 is formed from an endless conveyor chain 148 that includes two chain loops indicated generally at 150*a*, 150*b* (a portion shown in FIG. 9), each formed from a plurality of interconnected chain links 151. As is typical, each chain link 151 includes a guide hole 152. The support rods 130 include shafts 154 that enter through the guide holes 152 and "lock" the chain loops together.

Each support rod 130 has outwardly extending shafts 154 and a brass bearing member 156, rotatably positioned over each shaft 154, (FIG. 10). The brass members 156, are freely rotatable thereon, and could be retained by a washer and locknut 157 or an E-clip such as known to those skilled in the art. Typically, the support rods 130 are spaced such that the pitch between the crayons resting on the rods 130 is about one inch.

The shaft and members 154, 156, enter a groove 160 of respective parallel spaced guide plates 162 at the article wrapping position 33. As shown in FIG. 1, the conveyor follows the arcuate configured groove 160 so that any crayon carried thereon moves around the lower portion of the label drum 32. This allows a crayon held on the rods 130 to engage the surface of the label drum throughout its lower periphery. In one aspect of the invention, a rigid support surface 166 can be located underneath the conveyor proximal to the article wrapping position at a point where the conveyor approaches the label drum so that the conveyor chain 148 will not exert downward pressure and cause slack, which could create error during labeling.

The guide plates 162 are each mounted on two Thompson Bearings 167 which allows the guide plates to be raised and lowered independently of each other. The Thompson Bearings 167 rest on a horizontally configured support plate 168. The Thompson Bearings include a shaft 170 received within a bearing housing 171 as is conventional. Two jack screws 172 are positioned on either side of the article wrapping position 33 and rest on the support plate 168. The jack screws 172 raise the guide plates 162 toward the label drum and move the conveyor chain 148 closer toward the surface of the label drum, thus engaging the crayons carried thereon into engagement with the surface of the label drum. The amount that the jack screws 172 are turned corresponds to the desired pressure on the crayon during labeling. Also, the jack screws 172 can be turned to vary the camber of the article relative to the label to aid in ensuring end-to-end alignment during labeling. The jack screws 172 can be hydraulically operated coupled to a motor and drive mechanism (not shown in detail) so that an operator can readily control the camber and pressure of the crayon during labeling via a controller.

As illustrated in FIGS. 1 and 2, the support plate 168 is supported on a mounting plate 176 at each corner by jack screws 177. The support plate 168 is gimbled at the center so that the camber of the support plate 168 can be varied. The mounting plate 176 is closely spaced to the support plate 168. Small, finite adjustments in the camber of the support plate 168 relative to the mounting plate 176 are made by individually turning desired jack screws 177. A micrometer on the screws or other means can be used to determine the amount of movement.

As the label drum 32 continues its clockwise rotation, the labels then continue into the article wrapping position 33 where they engage the crayons advancing along the article conveyor 12.

As shown in FIG. 10, the crayons are conveyed onto the drum surface so that the crayon engages the leading edge of a label. At the same time, the leading edge ports 84 in the drum that are aligned with each insert plate move over the pressure manifold 76. The jet of air from the manifold forces outward the leading edge of the label into engagement with the crayon.

The label then wraps around the crayon twice and the adhesive is cooled as it rolls. During labeling side-to-side pressure on the crayon is varied to compensate for crayon taper. The original registration mark 17*a* is covered and printed indicia present on the label exposed. The crayon then moves into the discharge chute or conveyor 52.

The resilient silicon or similarly formed pads 78 can become very hot during high speed operation, and therefore a bank of airjets 180 are positioned on the label drum side opposing the heater assembly. These jets 180 blow high speed air onto the silicon pads to cool same. A compressed air source and lines 182 provide the necessary air flow.

In operation, a strip S is initially fed from a feed roll 18 into the feed roll assembly 26 and cutter drum assembly 28. The registration and sensor unit maintains proper registration of any label points with the cutting drum so that labels are cut at proper points and transferred exactly onto the label retaining positions 46 of the label transport drum 42. The drum rotates and moves labels through the heating tunnel 48, and then into the article wrapping position 33 where the leading edge of the label is forced upward into engagement with the crayon, which has been fed into engagement with the drum by the conveyor. During wrapping, the applied differential pressure causes the label to skew during labeling with the result that the label is wrapped and has end-to-end alignment. The label then moves to a point where it is discharged onto a discharge conveyor chain 190 or other similar discharge device known to those skilled in the art.

It should be understood that the foregoing description of the invention is intended merely to be a illustrative thereof, and that other embodiments, modifications and equivalents may be apparent to those skilled in the art without departing from its spirit.

That which is claimed is:

1. A method for applying a label onto a substantially cylindrical article comprising the steps of feeding a thin layer, heat activated adhesive backed label onto the surface of a label drum so that the adhesive back faces outward from the drum, rotating the drum to move the label retained thereto into an article wrapping position at a lower portion of the drum, heating the adhesive as the drum rotates so that the adhesive obtains a sufficient temperature to melt, conveying a cylindrical article into an article wrapping position at the lower portion of the label drum and into rotative engagement with a label retained on the label drum by feeding the articles onto a vacuum wheel, and rotating the vacuum wheel to deposit the articles on a substantially horizontal chain conveyor formed of two chain loops each formed from a plurality of interconnected chain links, and including substantially parallel support rods extending between the chain loops and supported by the chain links, wherein said support rods are spaced a distance sufficient to allow an article to rest thereon, timing the vacuum wheel rotation to drop an article on two respective support rods when the two respective support rods are opposite a drop off point defined by the vacuum wheel, and transferring the label onto the cylindrical article by wrap around labeling.

2. A method according to claim 1 including conveying the article along a substantially arcuate path around the lower portion of the label drum and into engagement with the outer drum surface.

3. A method according to claim 1 including feeding film onto, the label drum at a position adjacent the upper portion of the drum.

4. A method according to claim 1 including feeding the articles from a hopper onto the vacuum wheel.

5. A method according to claim 1 including aligning the ends of the articles by engaging the ends with a registration wheel.

6. A method according to claim 1 wherein each chain link includes a guide hole, and wherein the spaced rods are received within the guide holes, and each rod includes a shaft extending outwardly from the chain link, and including moving the conveyor and receiving the shaft into an arcuate configured guide slot for moving the articles supported on the rods around the lower portion of the drum into a label wrapping position.

7. A method according to claim 1 including the step of imparting pressure to the article as it is wrapped.

8. A method according to claim 7 including biasing the article into the label drum by imparting upward pressure on the article against the surface of the label drum and the label retained thereon.

9. A method according to claim 1 including the step of initially engaging the leading edge of the label with the article for transferring the label about the article.

10. A method according to claim 1 including the step of drawing a vacuum through orifices contained on the surface of the label drum for retaining the label on the drum surface as the drum rotates, and then blowing the leading edge of the label onto the article.

11. A method according to claim 1 wherein the articles are crayons and the heat activated adhesive layer positioned on the back of the paper is about 0.0005–0.001 inches thick.

12. A method according to claim 11 wherein the heat activated adhesive has a melting range of about 140 to about 170 degrees Fahrenheit, and including the step of heating the adhesive for about 0.25 seconds.

13. An apparatus for applying a label onto a substantially cylindrical article comprising a label drum defining an article wrapping position at a lower portion of the label drum, means for feeding a thin layer, heat activated adhesive backed label onto the surface of said drum so that the adhesive back faces outward from the drum, means for rotating the label drum to move the label retained thereon into the article wrapping position, means for heating the adhesive as the drum rotates so that the adhesive obtains a sufficient temperature to melt, and a substantially horizontal chain conveyor formed of two chain loops each formed from a plurality of interconnected chain links, and including substantially parallel support rods extending between the chain loops and supported by the chain links, wherein said support rods are spaced to form a support surface on which the articles rest, said horizontal chain conveyor extending into an article wrapping position at the lower portion of the label drum wherein the conveyor moves articles into rotative engagement with a label retained on the label drum so that the label is transferred onto the label on the cylindrical article by wrap around labeling, and including a rotatable vacuum wheel positioned adjacent to the chain conveyor for receiving articles, and depositing articles onto the chain conveyor, wherein the vacuum wheel rotation is timed to drop an article on two respective support rods when the two respective support rods are opposite a drop off point defined by the vacuum wheel.

14. An apparatus according to claim 13 including means for feeding a label from a position located adjacent the upper portion of the label drum.

15. An apparatus according to claim 14 wherein said label feed means includes means for feeding and cutting a strip of label material into rectangular sized labels and feeding the cut labels onto the surface of the label drum.

16. An apparatus according to claim 13 including means for biasing said conveyor upward toward said label drum for exerting pressure onto articles during labeling.

17. An apparatus according to claim 13 wherein said support rods include outwardly extending pins and bearings positioned on the pins, and including means positioned adjacent said article wrapping position for guiding the bearings in a predetermined arcuate path so that the articles are conveyed in a substantially arcuate path around the lower portion of said label drum.

18. The apparatus according to claim 13 including means for continuing rotation of the article after wrapping to cool the adhesive.

19. An apparatus according to claim 13 wherein said label transport drum includes orifices positioned on the surface of the drum at an area of said drum surface where a label is positioned, and including means for drawing a vacuum through said orifices for retaining the label on the drum surface as the drum rotates, and means for blowing air through said orifices underlying the leading edge of the label to blow the leading edge onto the article at the article wrapping position.

20. An apparatus according to claim 13 including a first heat source to heat the adhesive, and a second heat source for ensuring that the heat activated adhesive has obtained a sufficient temperature to melt so that it adheres to the cylindrical article.

21. An apparatus according to claim 13 wherein the articles are crayons and the heat activated adhesive layer positioned on the back of the paper is about 0.0005–0.001 inches thick.

22. An apparatus according to claim 21 wherein said heating means heats the heat activated adhesive to a range of about 140 to about 170 degrees Fahrenheit.

23. An apparatus according to claim 13 including means for imparting pressure to the article as it is wrapped.

* * * * *